US008744292B2

(12) United States Patent
Shibuya et al.

(10) Patent No.: US 8,744,292 B2
(45) Date of Patent: Jun. 3, 2014

(54) IMAGE FORMING APPARATUS AND METHOD FOR STOPPING DRIVING IMAGE CARRIER

(75) Inventors: Satoru Shibuya, Chiryu (JP); Hidetoshi Noguchi, Tahara (JP); Kazuyoshi Hara, Itami (JP); Takahiro Kuroda, Toyokawa (JP)

(73) Assignee: Konica Minolta Business Technologies, Chiyoda-Ku, Tokyo (JP)

( * ) Notice: Subject to any disclaimer, the term of this patent is extended or adjusted under 35 U.S.C. 154(b) by 316 days.

(21) Appl. No.: 13/168,168

(22) Filed: Jun. 24, 2011

(65) Prior Publication Data

US 2012/0008967 A1 Jan. 12, 2012

(30) Foreign Application Priority Data

Jul. 7, 2010 (JP) ..... 2010-155206

(51) Int. Cl.

*G03G 15/00* (2006.01)
*G03G 13/14* (2006.01)
*G03G 15/01* (2006.01)

(52) U.S. Cl.

CPC ..... *G03G 15/00* (2013.01); *G03G 13/14* (2013.01); *G03G 15/0131* (2013.01)
USPC ..... 399/44; 399/297

(58) Field of Classification Search

CPC .... G03G 15/00; G03G 13/14; G03G 15/0131
USPC ..... 399/34, 101, 121, 264, 297, 312, 313
See application file for complete search history.

(56) References Cited

U.S. PATENT DOCUMENTS 5,585,904 A * 12/1996 Yamamoto et al. ..... 399/307
5,678,134 A 10/1997 Miki et al.

(Continued)

FOREIGN PATENT DOCUMENTS

EP 1 939 696 A1 7/2008
JP 2001-296755 A 10/2001

(Continued)

OTHER PUBLICATIONS

Office Action (Notification of Reasons for Refusal) dated Apr. 17, 2012, issued in corresponding Japanese Patent Application No. 2010-155206, and an English Translation thereof (with Verification of Translation). (5 pages).

(Continued)

*Primary Examiner* — Walter L Lindsay, Jr.
*Assistant Examiner* — Matthew Miller
(74) *Attorney, Agent, or Firm* — Buchanan Ingersoll & Rooney PC

(57) ABSTRACT

An image forming apparatus includes an image carrier to carry a toner image; a driving unit to drive the image carrier to rotate; a transfer unit to transfer the toner image at a transfer position; a cleaner at a cleaning position to remove toner remaining on the image carrier after transfer; an obtaining unit to obtain information indicating a likelihood of the remaining toner adhering to the image carrier; a judging unit to judge whether or not the likelihood is equal to or lower than a predetermined value; and a controller to control the driving unit (i) to stop driving the image carrier before a rear end of an area of the image carrier on which the toner remains reaches the cleaning position, when the judging unit judges affirmatively, and, (ii) to stop driving the image carrier after the cleaner removes the remaining toner, when the judging unit judges negatively.

12 Claims, 7 Drawing Sheets

(56) References Cited

U.S. PATENT DOCUMENTS

| | | | | |
|---|---|---|---|---|
| 6,256,461 | B1 | 7/2001 | Takeyama et al. | |
| 2008/0145081 | A1 * | 6/2008 | Woo et al. | 399/66 |

FOREIGN PATENT DOCUMENTS

| | | | |
|---|---|---|---|
| JP | 2005-31503 | A | 2/2005 |
| JP | 2010-002752 | A | 1/2010 |

OTHER PUBLICATIONS

Extended European Search Report dated Dec. 13, 2011, issued in the corresponding European Patent Application No. 11172655.0. (6 pages).

* cited by examiner

FIG. 6

| Information indicating print conditions | | | Correction coefficient |
|---|---|---|---|
| | Current | Previous | |
| Fixing temperature | Tfc | Tfp | Kf |
| Copy quantity | Nc | Np | Kn |
| Duplex printing | | | Kd |
| Standby time | S | | Ks |

IMAGE FORMING APPARATUS AND METHOD FOR STOPPING DRIVING IMAGE CARRIER

This application is based on application No. 2010-155206 filed in Japan, the content of which is hereby incorporated by reference.

BACKGROUND OF THE INVENTION (1) Field of the Invention

The present invention relates to a method for stopping driving an image carrier and an image forming apparatus that performs the method, and in particular to technology for controlling process of stopping driving the image carrier after transfer of a toner image.

(2) Description of Related Art

In general, an electrophotographic image forming apparatus such as a copying machine and a printer performs image formation in the following manner. A developer supplies toner to an electrostatic latent image formed on an image carrier such as a photosensitive drum to develop the electrostatic latent image. The developed toner image is directly transferred onto a sheet, or is transferred onto another image carrier such as an intermediate transfer belt and then transferred onto a sheet. After that, the transferred toner image is thermally fixed to the sheet to form an image.

When the toner image is transferred onto the sheet, not all toner on the image carrier is transferred onto the sheet, but a certain amount of toner remains on a surface of the image carrier without being transferred.

The remaining toner can stain the sheet in the subsequent image formation. In addition, once the remaining toner is melted by heat of a fixing unit and adheres to the intermediate transfer belt, an image is not formed in an area of the intermediate transfer belt to which the toner adheres. This can lead to a white spot phenomenon. Therefore, it is required to remove the remaining toner prior to the subsequent image formation. Various methods for removing the remaining toner are known. Among them, commonly used is a method of scraping and collecting the remaining toner from the surface of the image carrier by sliding an elastic plate-like cleaning blade on the surface, because the method is simple and inexpensive.

This method, however, has a problem that the intermediate transfer belt is worn away by friction with the cleaning blade and, as a result, deterioration of the intermediate transfer belt is accelerated.

In view of the above problem, as a method for reducing a distance that the intermediate transfer belt travels until it stops to reduce the wear, a method of stopping rotating the intermediate transfer belt immediately after remaining toner passes a transfer position without cleaning has been proposed. According to this method, when the intermediate transfer belt is driven to rotate to perform the subsequent image formation, remaining toner is removed eventually.

However, a fixing unit is normally provided immediately downstream from the transfer position in a conveyance direction of a sheet, and thus, in the vicinity of the transfer position, the temperature tends to be increased by heat of the fixing unit. In the above method, the toner remaining on the intermediate transfer belt without being removed might be melted by the heat and adhere to the intermediate transfer belt.

Furthermore, in recent years, in order to promote energy savings by reducing a fixing temperature, toner that can melt and be fixed at a lower temperature has been developed. With the use of such toner, remaining toner melts at a lower temperature and adheres to the intermediate transfer belt easily.

As technology for preventing remaining toner on the intermediate transfer belt from melting, Japanese Patent Application Publication No. 2005-31503 discloses a structure in which an intermediate transfer belt (intermediate transfer member) is cooled by a cooling fan.

Furthermore, Japanese Patent Application Publication No. 2001-296755 discloses another structure in which an exhaust fan is provided to cool the intermediate transfer belt by letting the air out of the image forming apparatus, a cooling fan is provided to directly cool the intermediate transfer belt, and a heat pipe is provided inside a driven roller to cool the intermediate transfer belt via the driven roller.

However, the structures disclosed in Japanese Patent Application Publication No. 2005-31503 and Japanese Patent Application Publication No. 2001-296755 do not reduce a distance that the intermediate transfer belt travels until it stops after secondary transfer, and therefore do not reduce the wear of the intermediate transfer belt caused by the cleaning blade.

In addition, a cooling fan is not preferred in terms of energy savings, because power consumption is increased by driving the cooling fan.

SUMMARY OF THE INVENTION

An image forming apparatus according to the present invention is an image forming apparatus for executing an image forming job, comprising: an image carrier configured to carry a toner image; a driving unit configured to drive the image carrier to rotate; a transfer unit configured to transfer the toner image onto a transfer-receiving body at a transfer position; a cleaner disposed at a cleaning position on a rotational path of the image carrier, and configured to remove toner remaining on the image carrier after transfer; an obtaining unit configured to obtain information indicating a likelihood of the remaining toner adhering to the image carrier; a judging unit configured to judge whether or not the likelihood indicated by the obtained information is equal to or lower than a predetermined value; and a controller configured to, at an end of the image forming job, control the driving unit (i) to stop driving the image carrier at a stop position before a rear end, with respect to a rotational direction of the image carrier, of an area of the image carrier on which the toner remains reaches the cleaning position, when the judging unit judges that the likelihood is equal to or lower than the predetermined value, and, (ii) to stop driving the image carrier after the cleaner removes the remaining toner, when the judging unit judges that the likelihood is higher than the predetermined value.

A method for stopping driving an image carrier according to the present invention is a method for stopping driving an image carrier performed by an image forming apparatus that transfers a toner image formed on the image carrier onto a transfer-receiving body at a transfer position, and removes toner remaining on the image carrier after transfer with use of a cleaner disposed at a cleaning position on a rotational path of the image carrier, the image carrier being driven to rotate by a driving unit, the method comprising: an obtaining step of obtaining information indicating a likelihood of the remaining toner adhering to the image carrier; a judging step of judging whether or not the likelihood indicated by the obtained information is equal to or lower than a predetermined value; and a controlling step of controlling, at an end of an image forming job, the driving unit (i) to stop driving the image carrier at a stop position before a rear end, with respect to a rotational direction of the image carrier, of an area of the image carrier on which the toner remains reaches the cleaning position, when the judging step judges that the likelihood is equal to or lower than the predetermined value, and, (ii) to stop driving the image carrier after the cleaner removes the remaining toner, when the judging step judges that the likelihood is higher than the predetermined value.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 6 is a table of coefficients for calculating an estimated internal temperature in embodiment 2 of the present invention.

DESCRIPTION OF PREFERRED EMBODIMENTS

Figure 1:
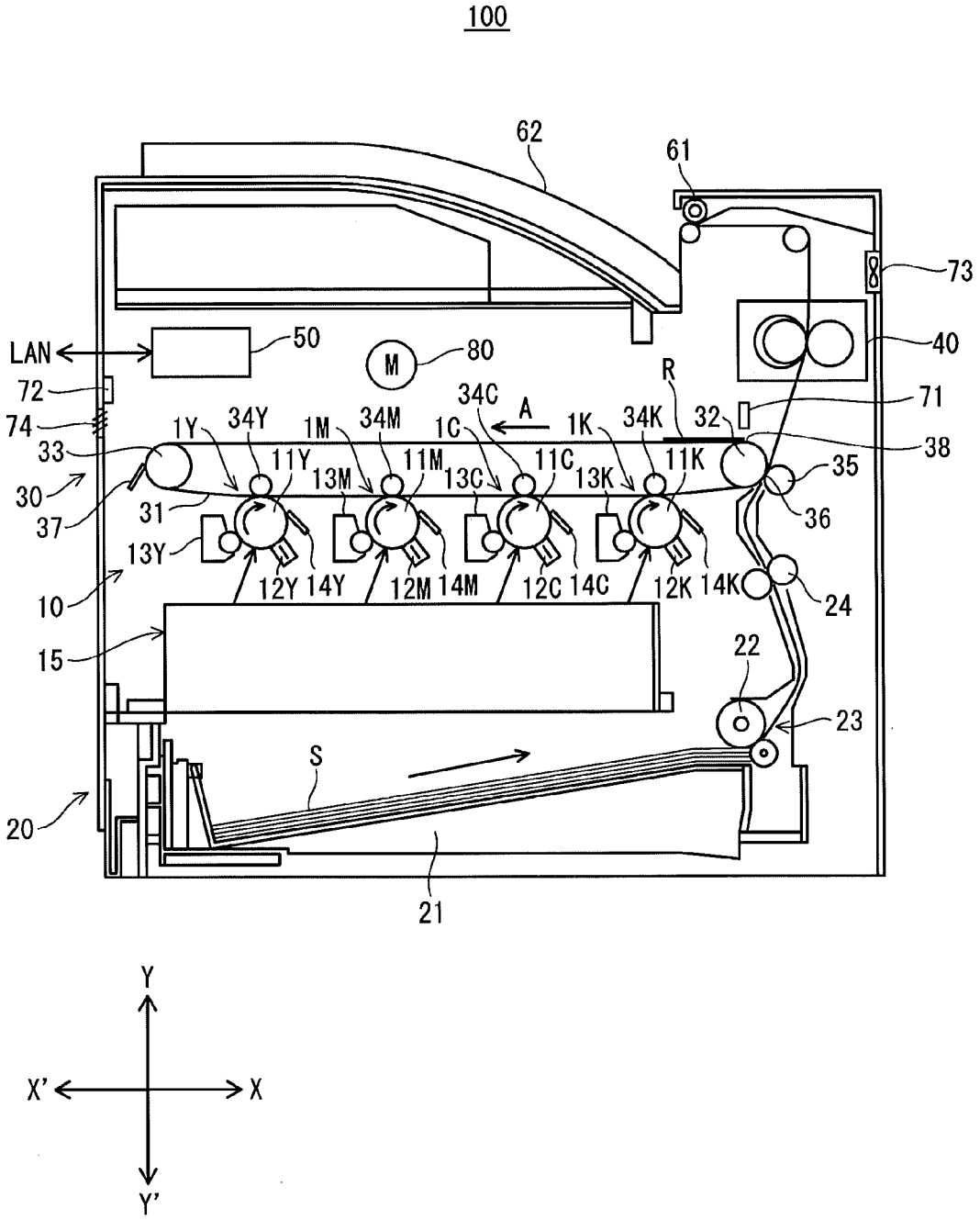
FIG. 1 is a schematic cross-sectional view showing a structure of an image forming apparatus in embodiment 1 of the present invention.

The present invention aims to provide (i) an image forming apparatus that maintains a favorable image quality by preventing remaining toner from adhering to an image carrier such as an intermediate transfer belt, extends the life of the image carrier, and reduces power consumption, and (ii) a method for stopping driving the image carrier performed by the image forming apparatus.

In order to achieve the above-mentioned aim, one aspect of the present invention is an image forming apparatus for executing an image forming job, comprising: an image carrier configured to carry a toner image; a driving unit configured to drive the image carrier to rotate; a transfer unit configured to transfer the toner image onto a transfer-receiving body at a transfer position; a cleaner disposed at a cleaning position on a rotational path of the image carrier, and configured to remove toner remaining on the image carrier after transfer; an obtaining unit configured to obtain information indicating a likelihood of the remaining toner adhering to the image carrier; a judging unit configured to judge whether or not the likelihood indicated by the obtained information is equal to or lower than a predetermined value; and a controller configured to, at an end of the image forming job, control the driving unit (i) to stop driving the image carrier at a stop position before a rear end, with respect to a rotational direction of the image carrier, of an area of the image carrier on which the toner remains reaches the cleaning position, when the judging unit judges that the likelihood is equal to or lower than the predetermined value, and, (ii) to stop driving the image carrier after the cleaner removes the remaining toner, when the judging unit judges that the likelihood is higher than the predetermined value.

With the above structure, when the likelihood of the remaining toner adhering to the image carrier is equal to or lower than the predetermined value, there is no possibility that the remaining toner adheres to the surface of the image carrier. Therefore, while a favorable image quality is maintained, the distance that the image carrier travels until it stops after transfer is reduced by stopping driving the image carrier before the rear end, with respect to the rotational direction of the image carrier, of the area of the image carrier on which the toner remains reaches the cleaning position. As a result, the wear of the image carrier caused by friction with the cleaner is reduced to extend a life of the image carrier, and power consumption is reduced.

On the other hand, when the likelihood is higher than the predetermined value and there is a possibility that the remaining toner melts and adheres to the surface of the image carrier, a favorable image quality is maintained by stopping driving the image carrier after the cleaner removes the remaining toner.

Here, another aspect of the present invention is the image forming apparatus, wherein the obtaining unit estimates, based on the information obtained at a specific position on the rotational path, a variation of the likelihood in a region from the transfer position to the cleaning position on the rotational path in the rotational direction, the judging unit further judges whether or not the region includes a position at which the likelihood is equal to or lower than the predetermined value, and (i) when the judging unit judges affirmatively, the controller sets the position at which the likelihood is equal to or lower than the predetermined value as the stop position, and controls the driving unit to stop driving the image carrier when the rear end reaches the stop position, and, (ii) when the judging unit judges negatively, the controller controls the driving unit to stop driving the image carrier after the cleaner removes the remaining toner.

With the above structure, the obtaining unit estimates a variation of the likelihood in the region from the transfer position to the cleaning position on the rotational path in the rotational direction. Therefore, there is no need to provide a sensor for sensing the variation of the likelihood over the region. This helps to save the costs.

Also, yet another aspect of the present invention is the image forming apparatus, wherein the obtained information includes at least one of environmental information on the vicinity of the cleaner and environmental information on the vicinity of the transfer position, and the environmental information includes at least one of temperature and humidity.

With this structure, the judging unit judges whether or not the likelihood is equal to or lower than the predetermined value based on the environmental information on both ends of the region on the rotational path in the rotational direction. Compared with a case where environmental information on a position away from the region is used, the judging unit can make a judgment more precisely.

Also, since the judging unit judges whether or not the likelihood is equal to or lower than the predetermined value based on the temperature and/or the humidity, which are elements that can greatly affect the likelihood of the remaining toner adhering to the image carrier, the judging unit can make a judgment more precisely.

Also, the present invention may be a method for stopping driving the image carrier performed by an image forming apparatus having the above-mentioned features. In this case, the similar effects can be obtained.

Embodiment 1

The following describes embodiments of a fixing unit and an image forming apparatus of the present invention by taking a tandem-type color digital printer (hereinafter, simply referred to as a "printer") as an example.

1-1. Overall Structure of Printer

FIG. 1 is a schematic cross-sectional view showing an overall structure of a printer 100 in embodiment 1 of the present invention. The printer 100 includes an image forming unit 10, a paper feeder 20, a transfer unit 30, a fixing unit 40, and a controller 50.

The printer 100 is connected to a network (e.g. LAN: Local Area Network). Upon receiving an instruction to execute a print job from an external terminal device (not illustrated), the printer 100 forms toner images of cyan, magenta, yellow, and black colors based on the instruction, and performs full color image formation by multi-transferring the formed toner images.

Hereinafter, reproduction colors of the cyan, magenta, yellow, and black are represented as C, M, Y, and K, respectively. The letters C, M, Y, and K are appended to reference numbers of components relating to the cyan, magenta, yellow, and black, respectively.

The image forming unit 10 includes imaging units 1C, 1M, 1Y, and 1K, an optical unit 15, an intermediate transfer belt 31, and cleaning blades 14 and 37.

The intermediate transfer belt 31 is an endless belt that is bridged in a tensioned state between a driving roller 32 and a driven roller 33, and is driven to rotate in a direction of an arrow A.

The cleaning blades 14 and 37 are respectively provided to come in contact with a photosensitive drum 11 and the intermediate transfer belt 31 in a counter direction. The cleaning blades 14 and 37 respectively clean surfaces of the photosensitive drum 11 and the intermediate transfer belt 31 to remove remaining toner, paper dusts and so on.

The optical unit 15 includes a light emitting element such as a laser diode. The optical unit 15 emits laser light and performs exposure scanning on the photosensitive drums 11C, 11M, 11Y, and 11K to form images of C, M, Y, and K colors, respectively, by a drive signal transmitted from the controller 50. By the exposure scanning, electrostatic latent images are formed on the photosensitive drums 11C, 11M, 11Y, and 11K having been charged by chargers 12C, 12M, 12Y, and 12K, respectively. The formed electrostatic latent images are developed by developers 13C, 13M, 13Y, and 13K to form toner images of C, M, Y, and K colors on the photosensitive drums 11C, 11M, 11Y, and 11K, respectively. The formation of the electrostatic latent images are performed at different timings so that the toner images of C, M, Y, and K colors are primary-transferred onto the same position on the intermediate transfer belt 31 in layers. The toner images of C, M, Y, and K colors are sequentially transferred onto the intermediate transfer belt 31 by electrostatic force applied by the primary transfer rollers 34C, 34M, 34Y, and 34K, respectively. The toner images form a full color toner image as a whole. Then, the formed full color toner image is conveyed to a secondary transfer position 36.

The paper feeder 20 includes a paper feed cassette 21 that stores therein a sheet S, a pick-up roller 22 that picks up the sheet S stored in the paper feed cassette 21 one sheet at a time to a conveyance path 23, a timing roller pair 24 that measures a timing of conveying the picked-up sheet S to the secondary transfer position 36. The sheet S is conveyed from the paper feeder 20 to the secondary transfer position 36 in accordance with a timing at which toner images formed on the intermediate transfer belt 31 are conveyed to the secondary transfer position 36. The toner images formed on the intermediate transfer belt 31 are collectively secondary-transferred onto the sheet S by electrostatic force applied by a secondary transfer roller 35.

Note that the imaging unit 10, the primary transfer roller 34 and the intermediate transfer belt 31 constitute a primary transfer unit, and the secondary transfer roller 35, the driving roller 32 and the intermediate transfer belt 31 constitute a secondary transfer unit. The primary transfer unit and the secondary transfer unit constitute the transfer unit 30.

After passing the secondary transfer position 36, the sheet S is conveyed to the fixing unit 40. The fixing unit 40 fixes the toner image (unfixed image) onto the sheet S by applying heat and pressure. The sheet S is then ejected onto a receiving tray 62 via an ejecting roller pair 61.

The controller 50 establishes communication with an external terminal, performs image processing, performs driving control over the above-described units, and so on.

An operation panel 8 (see FIG. 2) is provided on a front surface of the printer 100 so that a user can easily operate the operation panel 8. For example, the operation panel 8 includes: a numeric keypad for inputting copy quantity; a copy start key for starting copying; a key for selecting an image formation mode; and a touch panel-type liquid crystal display screen on which messages indicating conditions of the printer 100 are displayed, such as a condition in which the printer 100 is waiting for an instruction for executing a job (a standby condition). A touch panel function of the liquid crystal display screen enables the operation panel 8 to receive selection of a paper feed tray or an instruction for adjusting the image density.

At a side further downstream than the secondary transfer position 36 in a running direction of the intermediate transfer belt 31 and in the vicinity of the secondary transfer position 36, an internal temperature sensor 71 is provided to sense the temperature in the vicinity of the secondary transfer position 36.

In the vicinity of the cleaning blade 37, an outside air temperature sensor 72 is provided to sense the temperature of the air outside the printer 100.

Figure 2:
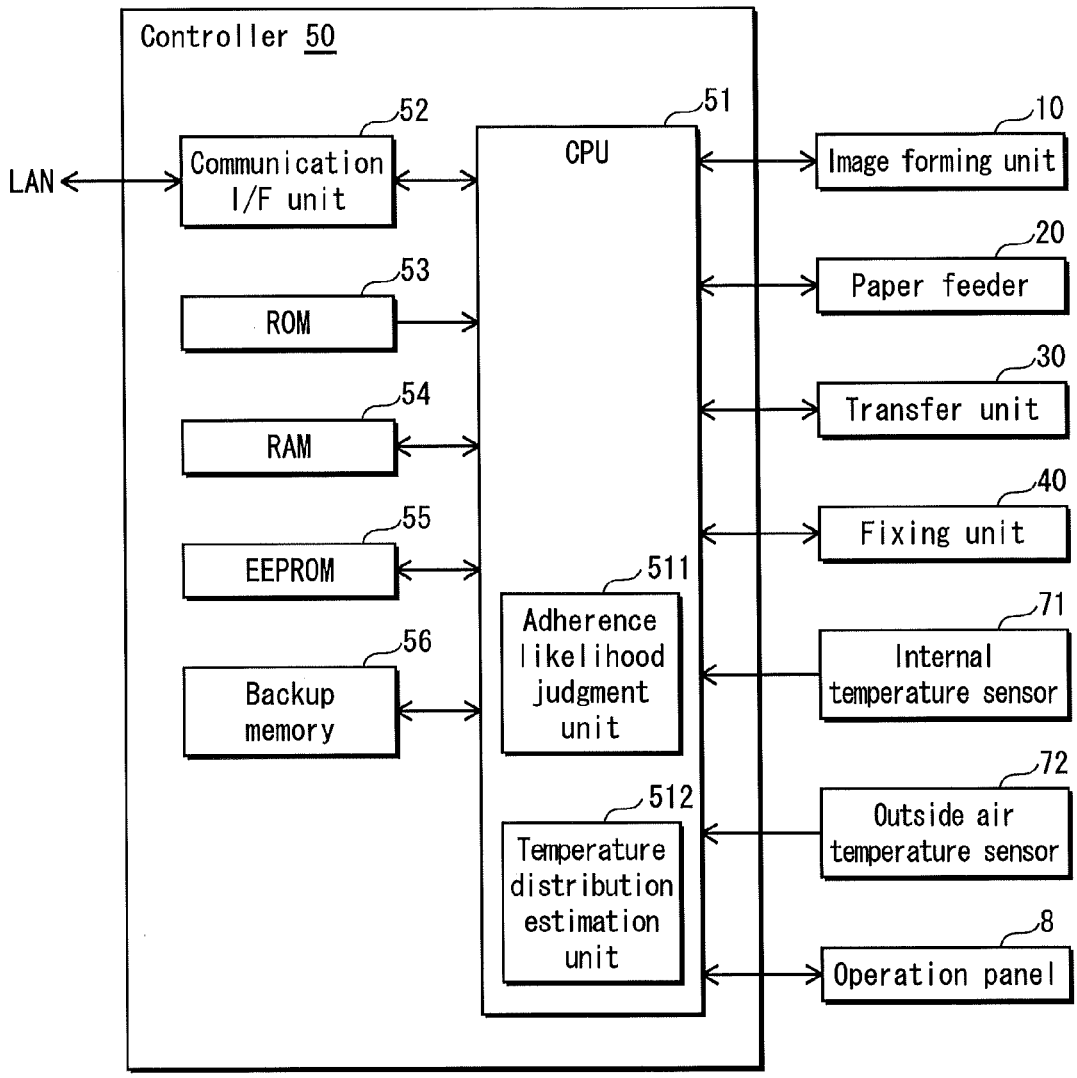
FIG. 2 is a block diagram showing a structure of a controller in the image forming apparatus.

FIG. 2 is a block diagram showing a structure of the controller 50. As shown in FIG. 2, the controller 50 includes, as main components, a CPU (Central Processing Unit) 51, a communication interface (I/F) unit 52, a ROM (Read Only Memory) 53, a RAM (Random Access Memory) 54, an EEPROM (Electrically Erasable and Programmable Read Only Memory) 55 and a backup memory 56.

The communication I/F unit 52 is an interface to establish connection with a LAN such as a LAN card and a LAN board, and receives data for a print job from an external source.

The CPU 51 fetches a necessary program from the ROM 53. The CPU 51 uniformly controls operations of the image forming unit 10, the paper feeder 20, the transfer unit 30, the fixing unit 40 at an appropriate timing so that a print operation is smoothly performed based on the data for a print job received by the communication I/F unit 52.

The EEPROM 55 is a nonvolatile memory. The EEPROM 55 stores therein information such as transfer voltage information and image stabilizing parameter values.

The backup memory 56 is a nonvolatile memory such as an EEPROM. The backup memory 56 stores therein information indicating a fixing temperature, copy quantity, and whether to perform duplex printing or one-side printing with respect to the input print job. The backup memory 56 also stores therein table data for estimating temperature distribution in a stopping candidate region on the intermediate transfer belt 31. The details will be described later.

The backup memory 56 is not necessarily a memory device provided independently. The backup memory 56 may be realized as a function of the EEPROM 55 for storing the information for the print job and a function of the ROM 53 for storing the table data for estimating the temperature distribution.

An adherence likelihood judgment unit 511 and a temperature distribution estimation unit 512 are included in the CPU 51.

The temperature distribution estimation unit 512 estimates temperature distribution in a region from an internal temperature sensing position 38 to the cleaning blade 37. The internal temperature sensing position 38 is located in the vicinity of and further downstream than the secondary transfer position 36 in a running direction of the intermediate transfer belt 31 and at a position on the rotational path of the intermediate transfer belt 31 that is the closest to the internal temperature sensor 71.

The adherence likelihood judgment unit 511 judges whether the temperature sensed by the internal temperature sensor 71 is equal to or lower than a predetermined temperature at which there is no possibility that the remaining toner melts. The adherence likelihood judgment unit 511 further judges whether the stopping candidate region includes a position where the temperature is equal to or lower than the predetermined temperature, based on the temperature distribution estimated by the temperature distribution estimation unit 512.

The details of the adherence likelihood judgment unit 511 and the temperature distribution estimation unit 512 are described later.

The CPU 51 is not limited to a single CPU, and may consist of a plurality of CPUs operating in corporation with one another.

1-2. Control Process of Stopping Driving Intermediate Transfer Belt (1-2-1. Temperature Distribution)

In order to reduce the size of an image forming apparatus such as a printer, a fixing unit is normally provided immediately downstream from the secondary transfer position, and thus, in the vicinity of the secondary transfer position, the temperature tends to be increased by heat of the fixing unit.

Also, cleaning performance of the cleaning blade is reduced as the cleaning blade is softened by heat, since the cleaning blade is made of rubber and the like. Therefore, the cleaning blade is generally provided at a position away from the secondary transfer position.

In addition, in order to reduce the size of the apparatus in the height direction (in a Y-Y' direction in FIG. 1), the cleaning blade is normally provided in the lateral direction (in an X or X' direction) of the intermediate transfer belt, rather than provided in an upward direction (in a Y direction) or in a downward direction (in a Y' direction).

Therefore, as shown in FIG. 1, the following structure is widely adopted. The fixing unit 40 and the cleaning blade 37 are respectively provided at one end and the other end of the intermediate transfer belt 31 bridged in a tensioned state between the driving roller 32 and the driven roller 33 in a horizontal direction.

With this structure, in order to remove the remaining toner R by using the cleaning blade 37 after the secondary transfer, it is required to rotate the intermediate transfer belt 31 approximately half a turn. This is one of causes that accelerate the wear of the intermediate transfer belt 31 caused by the cleaning blade 37.

Therefore, the wear of the intermediate transfer belt 31 caused by the cleaning blade 37 is reduced by providing the cleaning blade 37 at a position closer to the secondary transfer position, or by stopping driving the intermediate transfer belt 31 before the remaining toner R reaches the cleaning blade 37.

As described above, however, it is difficult to provide the cleaning blade 37 in the vicinity of the secondary transfer position located immediately upstream from the fixing unit 40 in a conveyance direction of a sheet because the influence of the heat from the fixing unit 40 should be minimized.

A heat shielding member may be provided between the fixing unit 40 and the cleaning blade 37 to keep out heat of the fixing unit 40. This, however, leads to an increase in cost, and also leads to an increase in size of the apparatus as a space for providing the heat shielding member is required.

In order to solve the above problem, in embodiment 1, temperature distribution is estimated in a region from the internal temperature sensing position 38 to the cleaning blade 37 on the rotational path of the intermediate transfer belt 31 based on the temperature sensed by the internal temperature sensor 71 and the outside air temperature sensor 72. Then, based on the estimated temperature distribution, a judgment is made to determine whether the region includes positions where the temperature is equal to or lower than the temperature at which there is no possibility that the remaining toner R melts and adheres to the intermediate transfer belt 31. When the region includes the positions where the temperature is equal to or lower than the predetermined temperature, a position at which the temperature is the highest of the included positions (hereinafter, referred to as a "safety temperature") is set as a stop position where the intermediate transfer belt 31 is stopped rotating. When a rear end, with respect to the running direction of the intermediate transfer belt 31, of an area of the intermediate transfer belt 31 on which the toner R remains reaches the stop position, a motor 80 for driving the driving roller 32 is controlled to stop driving the intermediate transfer belt 31. Hereinafter, the rear end, with respect to the running direction of the intermediate transfer belt 31, of an area of the intermediate transfer belt 31 on which the toner R remains is referred to as a "rear end of the remaining toner R". The region from the internal temperature sensing position 38 to the cleaning blade 37 on the rotational path of the intermediate transfer belt 31 is referred to as the "stopping candidate region".

Note that the rear end of the remaining toner R is specified, for example, in the following manner. The elapsed time since the exposure scanning performed on the photosensitive drum 11 is completed is measured. By dividing a distance from a position where the exposure scanning is performed to the primary transfer position by a rotation speed of the photosensitive drum 11, a timing at which a rear end of a toner image formed on the photosensitive drum 11 is transferred onto the intermediate transfer belt 31 is calculated. Then, by multiplying the elapsed time since the calculated transfer timing by the running speed of the intermediate transfer belt 31, a running distance of the rear end of the toner image from the primary transfer position is obtained. The rear end of the remaining toner R is specified as the running distance of the rear end of the toner image from the primary transfer position. When a color image is formed, a timing at which a rear end of a toner image formed on each photosensitive drum 11 is transferred onto the intermediate transfer belt 31 is calculated. Of the toner images of C, M, Y, and K, the furthest downstream rear end can be taken as the rear end of the remaining toner R of the color image. In this case, the rear end of the remaining toner R is sensed more precisely.

The rear end of the remaining toner R may also be specified in the following manner. A timing at which a rear end of a sheet passes the secondary transfer position 36 is calculated from a timing at which the rear end of the sheet is sensed by a sheet sensor (not illustrated) provided on a conveyance path of the sheet. A position on the intermediate transfer belt 31 where the rear end of the sheet is in contact therewith when the rear end of the sheet passes the secondary transfer position 36 is considered as the rear end of the remaining toner R (i.e. the rear end of the sheet is considered to be nearly identical to the rear end of the toner image). By multiplying the elapsed time since the rear end of the sheet passes the secondary transfer position 36 by the running speed of the intermediate transfer belt, a running distance of the intermediate transfer belt is obtained. The rear end of the remaining toner R is specified, considering the obtained running distance as the running distance of the rear end of the toner image from the secondary transfer position 36.

The method for specifying the rear end of the remaining toner R is not limited to the above. The rear end of the remaining toner R may be specified in other appropriate manners.

Figure 3:
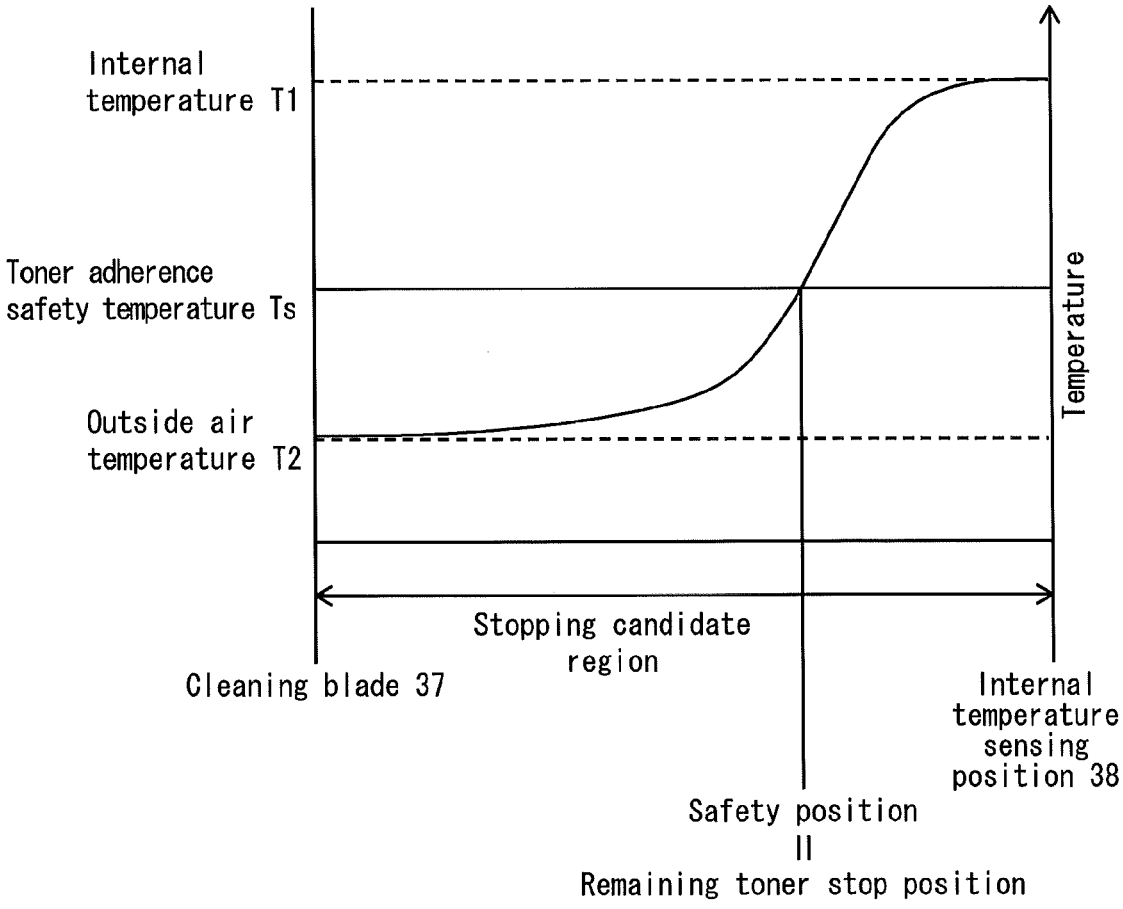
FIG. 3 is a graph showing temperature distribution in a stopping region.

FIG. 3 is a graph showing temperature distribution in the stopping candidate region. The graph shows distribution of air temperature in the vicinity of a surface of the intermediate transfer belt 31. Specifically, the vicinity of the surface of the intermediate transfer belt 31 indicates an area 20 [mm] from the surface of the intermediate transfer belt 31. During an image forming operation, the intermediate transfer belt 31 is driven to rotate, and thus the surface temperature thereof is evened out. Therefore, in many cases, the temperature distribution immediately after the operation differs from that shown in FIG. 3. However, a material constituting the intermediate transfer belt 31, such as a resin, is extremely thin (e.g. 90 [μm]) and small in heat capacity. Therefore, in a relatively short time, the temperature distribution of the intermediate transfer belt 31 is approximately equal to the temperature distribution in the vicinity of the intermediate transfer belt 31 shown in FIG. 3.

As shown in FIG. 3, an internal temperature T1 sensed by the internal temperature sensor 71 is high due to the influence of the heat from the fixing unit 40. The temperature decreases with a decrease in distance to the cleaning blade 37.

Note that the graph in FIG. 3 shows an example of the temperature distribution. The temperature distribution may be different depending on a model of an apparatus, a use environment, use conditions and so on.

In the vicinity of the fixing unit 40 located at an X-direction side (see FIG. 1) of the printer 100, an exhaust fan 73 is provided. The air warmed by heat of the fixing unit 40 and moisture vapor generated by evaporation of moisture of a sheet during fixing are discharged by the exhaust fan 73. In the vicinity of the cleaning blade 37 and the outside air temperature sensor 72 located at an X'-direction side (see FIG. 1) of the printer 100, an air inlet 74 is provided to take in the outside air. The inside air is discharged by the exhaust fan 73, and the outside air is taken in from the air inlet 74. Therefore, the temperature in the vicinity of the cleaning blade 37 is approximately the same as the temperature of the outside air. For this reason, in embodiment 1, the temperature of the outside air T2 sensed by the outside air temperature sensor 72 is considered as the surface temperature of the intermediate transfer belt 31 at a position where the cleaning blade 37 is provided.

Referring back to a graph in FIG. 3, a toner adherence safety temperature Ts is a threshold between a temperature range in which there is a possibility that the remaining toner R melts and adheres to the surface of the intermediate transfer belt 31 and a temperature range in which there is no possibility that the remaining toner R melts and adheres to the surface of the intermediate transfer belt 31. Specifically, the toner adherence safety temperature Ts is set to be slightly lower than a melting temperature of toner, which is a glass transition temperature of toner, in order to avoid the risk of adherence and enhance the safety. The toner adherence safety temperature Ts varies depending on a model of an apparatus, and is determined for each apparatus in consideration of factors such as a size of an apparatus, a direction and a speed of the air current in the apparatus.

As for the graph showing the temperature distribution in FIG. 3, the backup memory 56 has stored therein data having been measured in advance for various combinations of the internal temperature T1 and the outside air temperature T2 through experiments and so on. The data is read from the backup memory 56 as necessary. The backup memory 56 may have stored therein data of the graph itself, or formula and so on for deriving the graph.

In the graph showing temperature distribution, when the stopping candidate region includes a position where the temperature is equal to the toner adherence safety temperature Ts, the temperature at any positions that are closer to the cleaning blade 37 and further downstream in the running direction of the intermediate transfer belt 31 than the included position is lower than the toner adherence safety temperature Ts. Therefore, there is no possibility that the remaining toner R melts and adheres to the intermediate transfer belt 31 if the intermediate transfer belt 31 is stopped rotating at a position where the rear end of the remaining toner R is closer to the cleaning blade 37 than the position where the temperature is equal to the toner adherence safety temperature Ts is in the graph showing temperature distribution. Hereinafter, in the graph showing temperature distribution, the position where the temperature is equal to the toner adherence safety temperature Ts is referred to as a "safety position".

Here, in order to reduce the wear of the intermediate transfer belt 31 as much as possible by reducing a running distance of the intermediate transfer belt 31, the intermediate transfer belt 31 should be stopped rotating when the rear end of the remaining toner R reaches the safety position. Hereinafter, the position where the intermediate transfer belt 31 is stopped rotating is referred to as a "remaining toner stop position".

Note that a DC motor is normally used as the motor 80 being a source to drive the intermediate transfer belt 31 to rotate (driving unit). In this case, it is difficult to precisely stop driving the intermediate transfer belt 31 at a desired position, unlike a stepping motor. The motor 80 may keep rotating for a while by inertial forces after being stopped driving.

Here, the expression "to stop driving the intermediate transfer belt 31 at the remaining toner stop position" includes the following cases: a case where process of stopping driving the intermediate transfer belt 31 is started at the moment the rear end of the remaining toner R reaches the remaining toner stop position; and a case where the process of stopping driving the intermediate transfer belt 31 is started before the rear end of the remaining toner R reaches the remaining toner stop position so that the intermediate transfer belt 31 is rotated by inertial forces, and, as a result, the rear end of the remaining toner R is at the remaining toner stop position when the intermediate transfer belt 31 is actually stopped rotating, or, as a result, the rear end of the remaining toner R is at a position slightly downstream from the remaining toner stop position. The same applies to embodiments 2 and 3 and modifications.

(1-2-2. Control Process of Stopping Driving Intermediate Transfer Belt)

Figure 4:
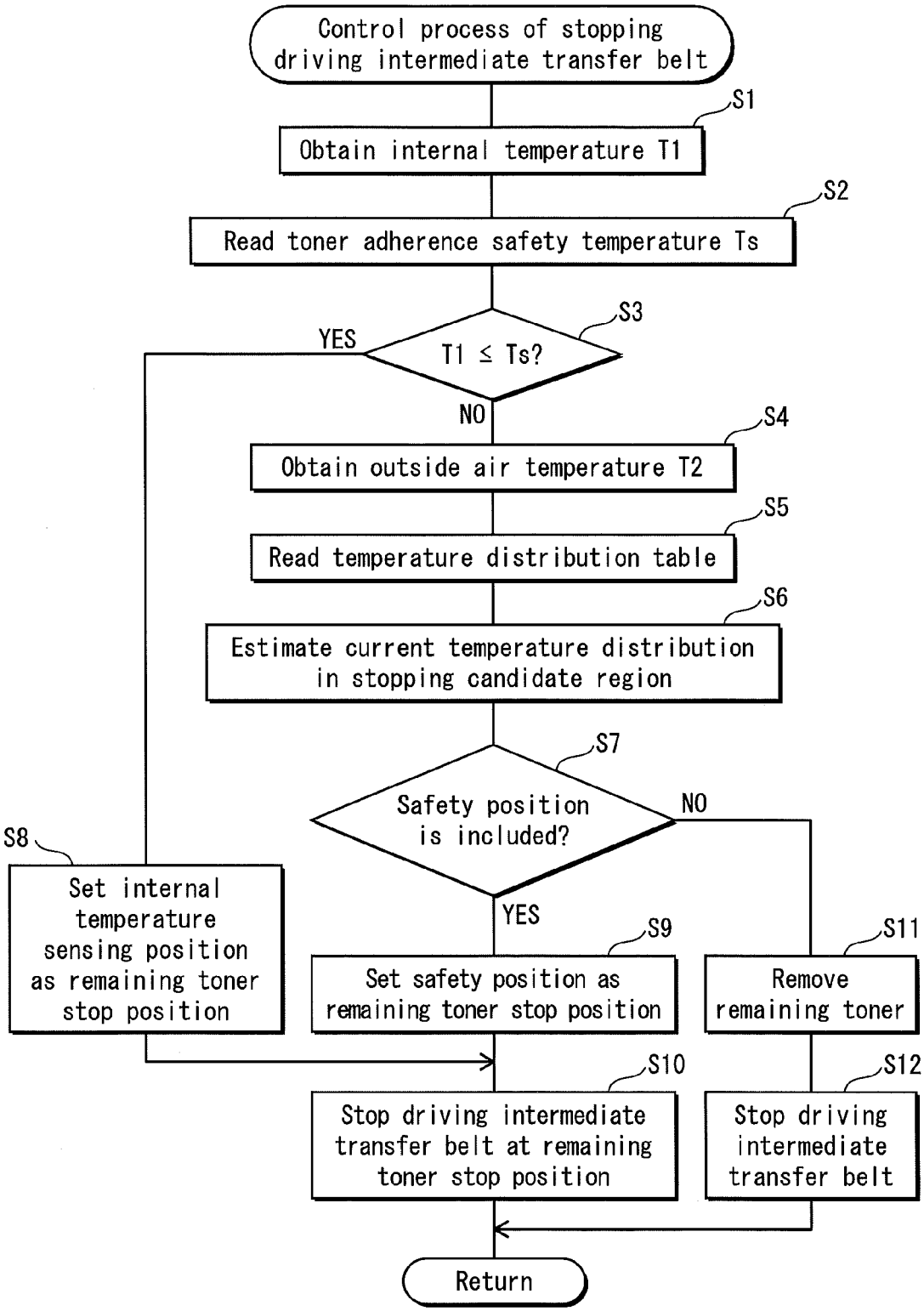
FIG. 4 is a flowchart showing control process of stopping driving an intermediate transfer belt in embodiment 1 of the present invention.

FIG. 4 is a flowchart showing control process of stopping driving the intermediate transfer belt in embodiment 1.

A main routine (not illustrated) for controlling the printer 100 as a whole exists independently, and the control process of stopping driving the intermediate transfer belt, which is a sub-routine, is conducted in response to a call from the main routine. The control process of stopping driving the intermediate transfer belt is performed at a timing at which an image formed at the end of a print job is secondary transferred. The same applies to the other embodiments and modifications.

In response to a call for the sub-routine of the control process of stopping driving the intermediate transfer belt, the internal temperature T1 sensed by the internal temperature sensor 71 is firstly obtained (step S1).

Then, the toner adherence safety temperature Ts is read from the backup memory 56, and the adherence likelihood judgment unit 511 judges whether the internal temperature T1 is equal to or lower than Ts (steps S2 and S3).

When the internal temperature T1 is equal to or lower than the toner adherence safety temperature Ts, the internal temperature sensing position 38 is set as the remaining toner stop position, and the intermediate transfer belt 31 is stopped rotating at the set remaining toner stop position (step S3: YES, steps S8 and S10). The process then returns to the main routine.

When the internal temperature T1 is higher than the toner adherence safety temperature Ts, the outside air temperature T2 sensed by the outside air temperature sensor 72 is obtained. Then, the data of the temperature distribution table is read from the backup memory 56, and the temperature distribution estimation unit 512 estimates the current temperature distribution in the stopping candidate region (step S3: NO, steps S4, S5 and S6).

Next, the adherence likelihood judgment unit 511 judges whether the stopping candidate region includes a safety position where the temperature is equal to the safety temperature based on the estimated temperature distribution (step S7).

When the stopping candidate region includes the safety position where the temperature is equal to the safety temperature, the safety position is set as the remaining toner stop position, and the intermediate transfer belt 31 is stopped rotating at the set remaining toner stop position (step S7: YES, steps S9 and S10). The process then returns to the main routine.

When the stopping candidate region does not include the safety position, the intermediate transfer belt is stopped rotating after the remaining toner is removed by the cleaning blade 37 (step S7: NO, steps S11 and S12). The process then returns to the main routine.

1-3. Summary of Embodiment 1

With the method in embodiment 1, when the internal temperature T1, which is a temperature at the internal temperature sensing position 38, is equal to or lower than the safety temperature Ts, there is no possibility that the remaining toner R adheres to the surface of the intermediate transfer belt 31. Therefore, the internal temperature sensing position 38 is set as the remaining toner stop position, and the intermediate transfer belt 31 is stopped rotating at the remaining toner stop position. When the internal temperature T1 is higher than the safety temperature Ts, the temperature distribution in the stopping candidate region is estimated, and a judgment is made to determine whether the stopping candidate region includes a safety position where the temperature is equal to the safety temperature Ts. When the stopping candidate region includes the safety position, the safety position is set as the remaining toner stop position and the intermediate transfer belt 31 is stopped rotating at the remaining toner stop position. When the stopping candidate region does not include the safety position, the intermediate transfer belt 31 is stopped rotating after the remaining toner is removed by the cleaning blade 37, as before. With this method, when the stopping candidate region includes the safety position, the intermediate transfer belt 31 is stopped rotating before the rear end of the remaining toner reaches the cleaning blade 37. With this structure, a distance that the intermediate transfer belt 31 travels until it stops after the secondary transfer is reduced, and the wear of the intermediate transfer belt 31 is reduced. In addition, since the distance is reduced, power consumption can be reduced.

Furthermore, when the internal temperature T1 is equal to or lower than the safety temperature Ts, the process of estimating temperature distribution can be omitted.

In addition, instead of further providing, at predetermined intervals, a plurality of temperature sensors between the internal temperature sensor 71 and the outside air temperature sensor 72 each positioned at opposite ends of the stopping candidate region, the temperature distribution in the stopping candidate region is estimated based on the temperature sensed by the internal temperature sensor 71 and the outside air temperature sensor 72. Therefore, there is no need to additionally provide the plurality of sensors to estimate the temperature distribution in the stopping candidate region. This helps to save the costs.

The internal temperature sensor 71, the outside air temperature sensor 72 and the temperature distribution estimation unit 512 are considered as an obtaining unit for obtaining the temperature as temperature information indicating a likelihood of the remaining toner adhering to the intermediate transfer belt 31, and temperature distribution by estimation.

Note that the internal temperature sensing position 38 is located in the vicinity of and further downstream than the secondary transfer position 36 in a running direction of the intermediate transfer belt 31. The distance from the secondary transfer position 36 to the internal temperature sensing position 38 may be equal to the distance from a position where the motor 80 for driving the intermediate transfer belt 31 to rotate is stopped driving to a position where the intermediate transfer belt 31 is actually stopped driving after being rotated by inertial forces (e.g., 30 [μm]). With this structure, the motor 80 is stopped driving immediately after the secondary transfer, and therefore the distance that the intermediate transfer belt 31 travels until it stops after the secondary transfer is minimized. As a result, a life of the intermediate transfer belt 31 can be fully extended.

Embodiment 2

In the above-mentioned embodiment 1, the temperature distribution in the stopping candidate region is estimated based on the internal temperature T1 sensed by the internal temperature sensor and the outside air temperature T2 sensed by the outside air temperature sensor.

In embodiment 2, the temperature distribution in the stopping candidate region is estimated without using the internal temperature sensor 71. Specifically, the internal temperature T1 is estimated based on the outside air temperature T2 sensed by the outside air temperature sensor 72 and information indicating print conditions of a print job currently being executed and a print job previously executed. The temperature distribution in the stopping candidate region is then estimated based on T2 and the estimated T1.

The same reference numbers are appended to components that are the same as those in embodiment 1, and explanation thereof is omitted.

The air inside the printer 100 is discharged by the exhaust fan 73, and the air outside the printer 100 is taken in from the air inlet 74. Therefore, the temperature of the air inside the printer 100 is affected by the outside air temperature T2. The internal temperature T1, which is the temperature at the internal temperature sensing position 38, is greatly affected by, in addition to the outside air temperature T2, heat of the fixing unit 40, because the internal temperature sensing position 38 is close to the fixing unit 40. The influence of the heat from the fixing unit 40 varies depending on conditions of a print job. Here, the conditions of a print job are, for example, a fixing temperature, copy quantity, and whether to perform duplex printing or one-side printing.

The fixing temperature varies depending on a type of a sheet such as a plain paper and a thick paper. If the fixing temperature is different, the internal temperature T1 is affected differently.

When the image forming apparatus is in a standby condition before an input of a print job, a heating roller of the fixing unit waits for the input at a standby temperature that is lower than the fixing temperature. Upon receiving the input of a print job, the temperature of the heating roller is increased to the fixing temperature to execute the print job. Therefore, if the copy quantity is large, the heating roller is maintained at the fixing temperature for a long time. This leads to an increase in internal temperature T1.

In a case of duplex printing, after the fixing unit 40 fixes a toner image on one surface to a sheet by heat, the sheet is conveyed again to the secondary transfer position 36 to transfer another toner image onto the other surface. At this time, the temperature of the sheet conveyed again has been increased because the sheet is heated during fixing of the toner image to one surface of the sheet. Therefore, the temperature in the vicinity of the secondary transfer position 36 is more likely to be increased.

In addition to print conditions of a current print job (a print job currently being executed), the internal temperature T1 is affected by print conditions of a previous print job (a print job previously executed). Furthermore, as described above, the standby temperature of the fixing unit 40 in a standby condition is set to be lower than the fixing temperature. Therefore, T1 is also affected by a length of standby time from completion of the previous print job till reception of the current print job.

In embodiment 2, as print conditions of the current and the previous print jobs, pieces of information about a fixing temperature, copy quantity, and whether to perform duplex printing or one-side printing are obtained. In addition, an internal temperature at the completion of the current print job is estimated based on a length of standby time from completion of the previous print job and the pieces of information so obtained. The temperature distribution in the stopping candidate region is estimated based on the estimated internal temperature (hereinafter, referred to as an estimated internal temperature "t1") and the outside air temperature T2 sensed by the outside air temperature sensor 72.

2-1. Control Process of Stopping Driving Intermediate Transfer Belt

Figure 5:
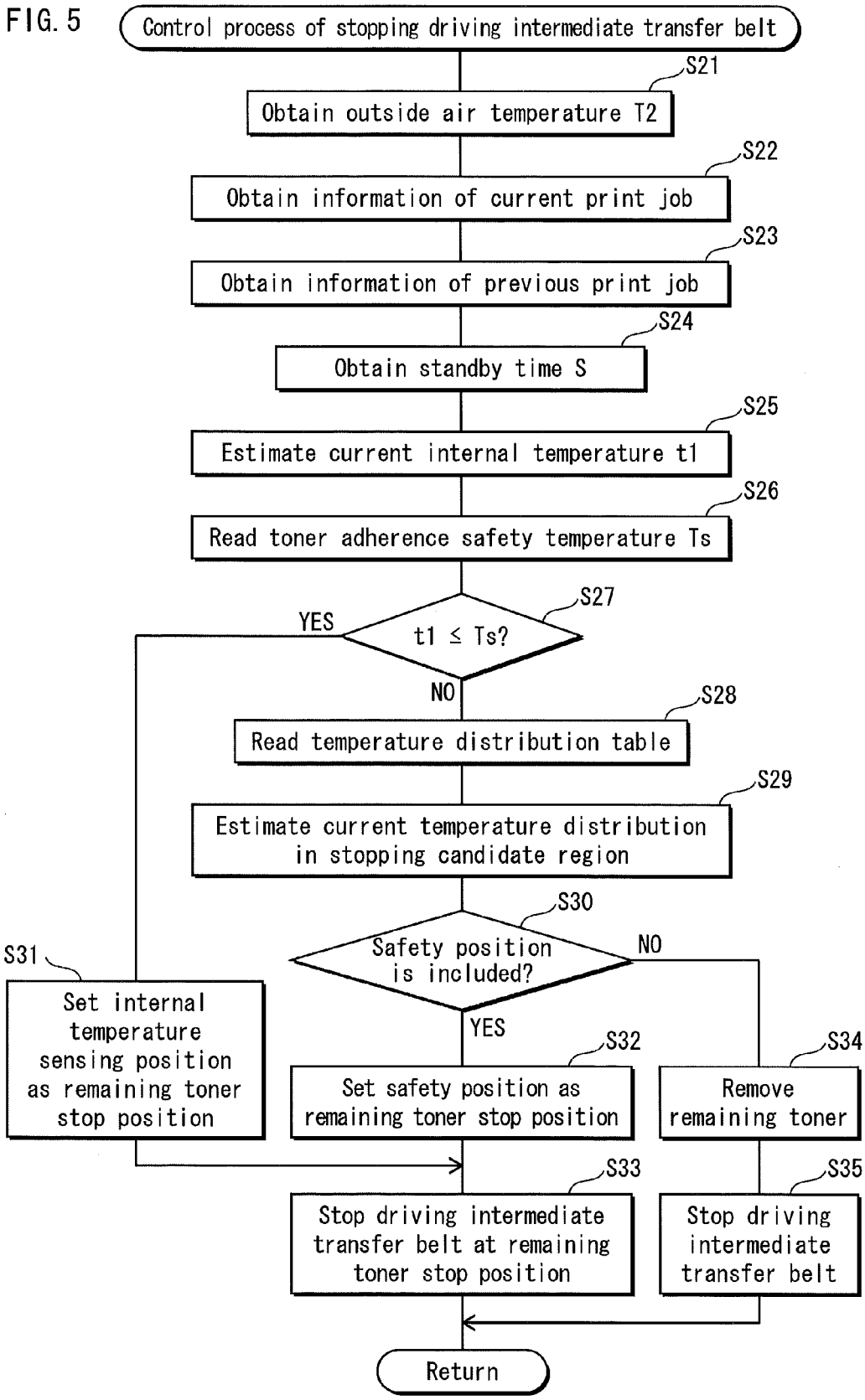
FIG. 5 is a flowchart showing control process of stopping driving the intermediate transfer belt in embodiment 2 of the present invention.

FIG. 5 is a flowchart showing control process of stopping driving the intermediate transfer belt in embodiment 2.

In response to a call for the sub-routine of control process of stopping driving the intermediate transfer belt, the outside air temperature T2 sensed by the outside air temperature sensor 72 is firstly obtained (step S21).

Next, information indicating print conditions of a current print job and information indicating print conditions of a previous print job are obtained, and a standby time S is obtained (steps S22, S23 and S24).

A current estimated internal temperature t1 is calculated by the following formula 1 based on the information indicating print conditions of the current print job, the information indicating print conditions of the previous print job and the standby time S (step S25). Here, the estimated internal temperature t1 may be calculated by the temperature distribution estimation unit 512.

$$t1=\{(Kf\times Tfc+Kn\times Nc)+(Kf\times Tfp+Kn\times Np)\}\times T2\times Kd-Ks\times T2\times S \quad \text{(Formula 1)}$$

Here, as shown in a table in FIG. 6, in formula 1, Tfc, Tfp, Nc and Np are variables indicating a fixing temperature of a current print job, a fixing temperature of a previous print job, copy quantity of the current print job and copy quantity of the previous print job, respectively. Also, Kf, Kn, Kd and Ks indicate a correction coefficient of the fixing temperature, a correction coefficient of the copy quantity, a correction coefficient in a case of a duplex printing (in a case of one-side printing, Kd is not set, or Kd=1) and a correction coefficient of the standby time, respectively. These correction coefficients are obtained in advance by an experiment and so on, and have been stored in the ROM 53 or the backup memory 56. These correction coefficients are read as necessary. Also, these correction coefficients may not be invariables, and may be variables determined by a value of T2 (function of T2).

Upon calculation of the estimated internal temperature t1 in step S25, the toner adherence safety temperature Ts is read from the backup memory 56, and the adherence likelihood judgment unit 511 judges whether the estimated internal temperature t1 is equal to or lower than Ts (steps S26 and S27).

When the estimated internal temperature t1 is equal to or lower than the toner adherence safety temperature Ts, the internal temperature sensing position 38 is set as the remaining toner stop position, and the intermediate transfer belt 31 is stopped rotating at the set remaining toner stop position (step S27: YES, steps S31 and S33). The process then returns to the main routine.

When the estimated internal temperature t1 is higher than the toner adherence safety temperature Ts, the data of the temperature distribution table is read from the backup memory 56, and the temperature distribution estimation unit 512 estimates the current temperature distribution in the stopping candidate region (step S27: NO, steps S28, S29 and S30).

Next, the adherence likelihood judgment unit 511 judges whether the stopping candidate region includes a safety position where the temperature is equal to the safety temperature based on the estimated temperature distribution (step S30).

When the stopping candidate region includes the safety position where the temperature is equal to the safety temperature, the safety position is set as the remaining toner stop position, and the intermediate transfer belt 31 is stopped rotating at the set remaining toner stop position (step S30: YES, steps S32 and S33). The process then returns to the main routine.

When the stopping candidate region does not include the safety position, the intermediate transfer belt is stopped rotating after the remaining toner is removed by the cleaning blade 37 (step S30: NO, steps S34 and S35). The process then returns to the main routine.

2-2. Summary Of Embodiment 2

With the structure in embodiment 2, the internal temperature is estimated based on the outside air temperature T2 sensed by the outside air temperature sensor 72, which is normally installed in an image forming apparatus, information indicating print conditions of the current and previous print jobs and the standby time S from completion of the previous print job till reception of the current print job. The temperature distribution in the stopping candidate region is then estimated based on the estimated internal temperature t1 and the outside air temperature T2 in a similar manner to embodiment 1. Therefore, there is no need to additionally provide the internal temperature sensor 71. In addition to the effect obtained in embodiment 1, an effect of reducing cost is obtained.

Embodiment 3

In the above-mentioned embodiments 1 and 2, the temperature distribution in the stopping candidate region is estimated, and then a judgment is made as to whether the stopping candidate region includes a safety position where the temperature is equal to the safety temperature Ts.

In embodiment 3, instead of estimating the temperature distribution in the stopping candidate region, control process of stopping driving the intermediate transfer belt is performed by judging whether the internal temperature T1 at the internal temperature sensing position is equal to or lower than the safety temperature.

Note that, the same reference numbers are appended to components that are the same as those in embodiment 1, and explanation thereof is omitted.

3-1. Control Process of Stopping Driving Intermediate Transfer Belt

Figure 7:
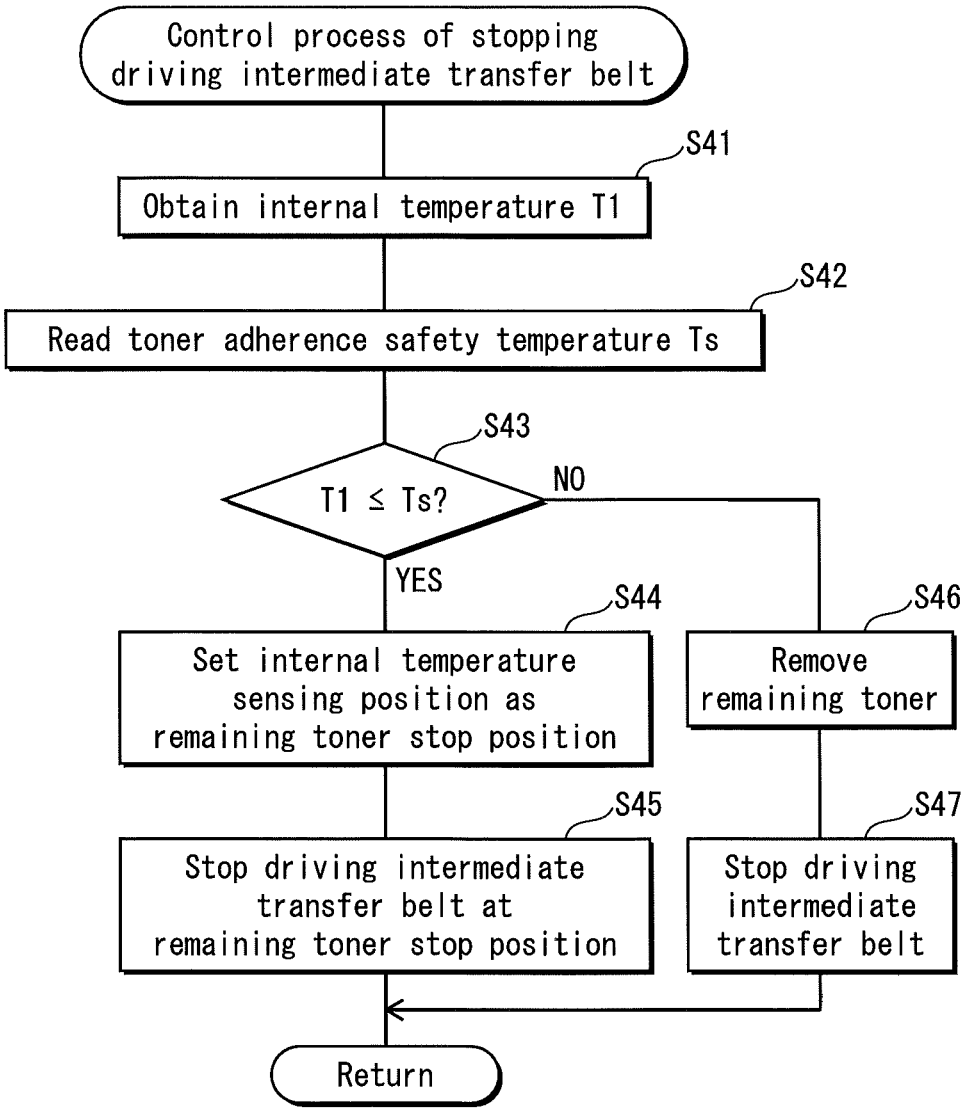
FIG. 7 is a flowchart showing control process of stopping driving the intermediate transfer belt in embodiment 3 of the present invention.

FIG. 7 is a flowchart showing control process of stopping driving the intermediate transfer belt in embodiment 1.

In response to a call for the sub-routine of the control process of stopping driving the intermediate transfer belt, the internal temperature T1 sensed by the internal temperature sensor 71 is firstly obtained (step S41).

Then, the toner adherence safety temperature Ts is read from the backup memory 56, and the adherence likelihood judgment unit 511 judges whether the internal temperature T1 is equal to or lower than Ts (steps S42 and S43).

When the internal temperature T1 is equal to or lower than the toner adherence safety temperature Ts, the internal temperature sensing position 38 is set as the remaining toner stop position, and the intermediate transfer belt 31 is stopped rotating at the set remaining toner stop position (step S43: YES, steps S44 and S45). The process then returns to the main routine.

When the estimated internal temperature t1 is higher than the toner adherence safety temperature Ts, the intermediate transfer belt 31 is stopped rotating after the remaining toner is removed by the cleaning blade 37 (step S43: NO, steps S46 and S47). The process then returns to the main routine.

3-2. Summary of embodiment 3

With the above-mentioned structure in embodiment 3, when the temperature T1 sensed by the internal temperature sensor 71 is equal to or lower than the safety temperature Ts, the internal temperature sensing position 38 is set as the remaining toner stop position, and the intermediate transfer belt 31 is stopped rotating at the remaining toner stop position. With this structure, since a distance that the intermediate transfer belt 31 travels until it stops after the secondary transfer is reduced, the wear of the intermediate transfer belt 31 is reduced, and power consumption is reduced.

<Modifications>

Although the present invention has been described based on the embodiments, it is obvious that the present invention is not limited to the above-mentioned embodiments, and various modifications as described below may be implemented.

(1) In addition to the temperature, humidity is considered as a main environmental element that can affect the likelihood of the remaining toner adhering to the image carrier. Under a high humidity environment, toner is likely to absorb the moisture in the air and adhere. Therefore, instead of temperature, humidity (relative humidity) may be sensed by a sensor as information indicating a likelihood of the remaining toner adhering to a surface of the intermediate transfer belt. A judgment may be made regarding the likelihood of the remaining toner R adhering to a surface of the intermediate transfer belt 31 based on the sensed humidity.

In this case, the temperature in embodiment 1 is replaced by the humidity. Humidity distribution in the stopping candidate region is estimated based on internal humidity and outside air humidity. Then, a judgment is made as to whether the stopping candidate region includes a safety position where the humidity is equal to a safety value (a value at which there is no possibility that the remaining toner R adheres to the intermediate transfer belt 31). When the stopping candidate region includes the safety position, the safety position is set as the remaining toner stop position, and the intermediate transfer belt 31 is stopped rotating at the remaining toner stop position. When the stopping candidate region does not include the safety position, the intermediate transfer belt 31 is stopped rotating after the remaining toner R is removed by the cleaning blade 37.

Also, the temperature in embodiment 2 may be replaced by the humidity. The internal humidity may be estimated based on the outside air humidity. After the humidity distribution in the stopping candidate region is estimated based on the estimated internal humidity and the sensed outside air humidity, the control process of stopping driving the intermediate transfer belt may be performed in a similar manner to the above.

Furthermore, the temperature in embodiment 3 may be replaced by the humidity. After the internal humidity is sensed, when the sensed internal humidity is equal to or lower than the safety value, an internal humidity sensing position is set as the remaining toner stop position, and the intermediate transfer belt 31 is stopped rotating at the remaining toner stop position. When the internal humidity is higher than the safety value, the intermediate transfer belt 31 may be stopped rotating after the remaining toner R is removed by the cleaning blade 37.

(2) In the above modification 1, instead of temperature, humidity (relative humidity) is used to judge whether there is a possibility that the remaining toner R adheres to a surface of the intermediate transfer belt 31 and whether there is a safety position where there is no possibility that the remaining toner R adheres to a surface of the intermediate transfer belt 31. The control process of stopping driving the intermediate transfer belt is then performed. The control process of stopping driving the intermediate transfer belt, however, may be performed in a similar manner based on both of the temperature and relative humidity.

In this case, absolute humidity that is obtained from the temperature and the relative humidity may be used. Pieces of information indicating the temperature and the relative humidity may be used separately. Also, environmental steps classified into a plurality of stages (e.g. eight stages) may be used as indicators of the absolute humidity.

The control process of stopping driving the intermediate transfer belt may be performed in a similar manner to the above, in consideration of other environmental elements that can affect the likelihood of the remaining toner adhering to the image carrier than the temperature and humidity.

(3) In each embodiment, the temperature distribution is estimated and control process is performed with respect to the intermediate transfer belt 31. The temperature distribution may be estimated and control process may be performed with respect to the photosensitive drum 11 as an image carrier.

In this case, on a rotational path of the photosensitive drum 11, a region from the primary transfer position to a cleaning position where the cleaning by the cleaning blade 14 is performed is considered as the stopping candidate region, and the temperature distribution in the stopping candidate region is estimated. Based on the estimated temperature distribution, a judgment is made as to whether the stopping candidate region includes a safety position where the temperature is equal to a safety temperature at which there is no possibility that the remaining toner adheres to a surface of the photosensitive drum 11. When the stopping candidate region includes the safety position, the safety position is set as the stop position, and the photosensitive drum 11 may be stopped rotating at the stop position.

Also in this case, by stopping driving the photosensitive drum 11 after the primary transfer before the remaining toner reaches the cleaning blade 14, a rotational distance that the photosensitive drum 11 is driven is reduced, and the wear of the photosensitive drum 11 caused by friction with the cleaning blade 14 is reduced. Therefore, a life of the photosensitive drum 11 is extended, and power consumption is reduced.

(4) In the above embodiments 1 and 3, in order to sense the internal temperature T1, the internal temperature sensor 71 is provided in the vicinity of and further downstream than the secondary transfer position 36 in a running direction of the intermediate transfer belt 31. The position of the internal temperature sensor 71 is not limited to this. For example, the internal temperature sensor 71 may be provided at any position from the secondary transfer position 36 to the cleaning blade 37 in the running direction of the intermediate transfer belt 31.

In this case, when the method in embodiment 1 is adopted, a region from the secondary transfer position 36 to the cleaning blade 37 through the internal temperature sensing position may be considered as the stopping candidate region, and the temperature distribution in the stopping candidate region may be estimated.

Also, in a case where the method in embodiment 3 is adopted, when the internal temperature T1 is equal to or lower than the toner adherence safety temperature Ts, the internal temperature sensing position is set as the remaining toner stop position. In this case, since the internal temperature sensing position is located further upstream than the cleaning blade 37 in the running direction of the intermediate transfer belt 31, the distance that the intermediate transfer belt 31 travels until it stops is reduced. Therefore, a life of the intermediate transfer belt 31 is extended, and power consumption is reduced. However, in terms of extension of a life of the intermediate transfer belt 31 and reduction in power consumption, the closer the internal temperature sensing position is to the secondary transfer position 36, the larger an expected effect is.

(5) In the above embodiments 1 and 2, the temperature distribution shows that the temperature at the internal temperature sensing position 38 is the highest in the stopping candidate region, and the temperature simply decreases with a decrease in distance to the cleaning blade 37. However, the temperature distribution pattern is not limited to this. Depending on a position of the internal temperature sensor 71, the structure and position of each component in the printer 100 and so on, for example, the temperature distribution may show a pattern that the temperature decreases and increases and then decreases again with a decrease in distance to the cleaning blade 37. Also, there may be a position where the temperature is higher than the temperature at the internal temperature sensing position 38. Also in such a case, by setting a position that is the closest to the cleaning blade 37 of all positions where the temperature is equal to the safety temperature as the remaining toner stop position, and by stopping driving the intermediate transfer belt 31 at the remaining toner stop position, the remaining toner is prevented from melting. In addition, since the intermediate transfer belt 31 is stopped rotating before the rear end of the remaining toner reaches the cleaning blade 37, the distance that the intermediate transfer belt 31 travels until it stops after the secondary transfer is reduced, and the wear of the intermediate transfer belt 31 is reduced.

(6) In the above embodiment 2, as print conditions to calculate the estimated internal temperature t1, pieces of information about a fixing temperature, copy quantity, whether to perform duplex printing or one-side printing and a standby time are used. However, the print conditions are not limited to these pieces of information. The estimated internal temperature t1 may be calculated considering the other elements affecting the internal temperature.

(7) In the above embodiment 2, the estimated internal temperature t1 is calculated by using the information indicating print conditions of the current print job, the information indicating print conditions of the previous print job and the standby time. However, information used to calculate the estimated internal temperature t1 is not limited to these pieces of information.

For example, the estimated internal temperature t1 may be calculated in the following manner. Operations currently being performed are checked at a predetermined time interval. An amount of increase or decrease of the internal temperature in the predetermined time according to an operating condition is calculated through estimation. The calculated amount of increase/decrease is cumulatively added/subtracted over time. In this case, for example, the predetermined time is 100 [ms], and the operation condition includes execution of a print operation, standby condition or driving of a cooling fan. For each operation, an increase rate or a decrease rate may be obtained by an experiment and so on and set in advance.

The increase rate and the decrease rate may be functions of the outside air temperature T2. Alternatively, the outside air temperature T2 may be classified into a plurality of stages, the increase rate and the decrease rate for each stage may be obtained in advance by an experiment and so on and stored in a table and the like, and the table may be stored in the ROM 53, the backup memory 56 and the like.

(8) In the above embodiments 1 and 2, the outside air temperature T2 sensed by the outside air temperature sensor 72 is used as the temperature in the vicinity of the cleaning blade 37. However, the outside air temperature T2 is not limited to this. For example, when the air inlet 74 is provided at a position away from the cleaning blade 37, the temperature in the vicinity of the cleaning blade 37 may greatly differ from the outside air temperature T2. In such a case, a temperature sensor for sensing the temperature of the cleaning blade 37 or the temperature in the vicinity of the cleaning blade 37 may be separately provided, and the temperature sensed by the sensor may be used to estimate the temperature distribution in the stopping candidate region.

(9) In the above embodiments 1 and 3, the internal temperature sensor 71 senses the temperature in the vicinity of the secondary transfer position 36 located further downstream than the secondary transfer position 36 in a running direction of the intermediate transfer belt 31. However, the temperature sensed by the internal temperature sensor 71 is not limited to this. For example, the internal temperature sensor 71 may directly sense the surface temperature of the units provided in the vicinity of the secondary transfer position 36, such as the driving roller 32, the secondary transfer roller 35 and a guide member forming the conveyance path.

(10) In the above embodiments and modifications, although a tandem-type color printer is taken as an example, the present invention is not limited to the tandem-type color printer. The present invention may generally be applied to an image forming apparatus, such as a monochrome printer, a 4-cycle color image forming apparatus, a copying machine, a fax machine and a multifunction peripheral (MFP) having functions of the above-mentioned devices, having a structure in which a toner image formed on a rotary image carrier is transferred onto a transfer-receiving body. That is to say, the present invention may be applied to a structure in which the image carrier is an intermediate transfer belt and the transfer-receiving body is a recording sheet (paper), or a structure in which the image carrier is a photosensitive drum and the transfer-receiving body is an intermediate transfer belt.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus for executing an image forming job, the image forming apparatus comprising:

an image carrier configured to carry a toner image;

a driving unit configured to drive the image carrier to rotate;

a transfer unit configured to transfer the toner image onto a transfer-receiving body at a transfer position;

a cleaner disposed at a cleaning position on a rotational path of the image carrier, and configured to remove toner remaining on the image carrier after transfer;

an obtaining unit configured to obtain information indicating a likelihood of the remaining toner adhering to the image carrier;

a judging unit configured to judge whether or not the likelihood indicated by the obtained information is equal to or lower than a predetermined value, and when the judging unit judges affirmatively, the controller sets a position at which the likelihood is equal to or lower than the predetermined value as the stop position; and a controller configured to, at an end of the image forming job, control the driving unit:

(i) to stop driving the image carrier at the stop position before a rear end, with respect to a rotational direction of the image carrier, of an area of the image carrier on which the toner remains reaches the cleaning position and when the rear end reaches the stop position, when the judging unit judges that the likelihood is equal to or lower than the predetermined value, and, (ii) to stop driving the image carrier after the cleaner removes the remaining toner, when the judging unit judges that the likelihood is higher than the predetermined value.

2. The image forming apparatus of claim 1, wherein the obtaining unit estimates, based on the information obtained at a specific position on the rotational path, a variation of the likelihood in a region from the transfer position to the cleaning position on the rotational path in the rotational direction, the judging unit further judges whether or not the region includes a position at which the likelihood is equal to or lower than the predetermined value, and when the judging unit judges negatively, the controller controls the driving unit to stop driving the image carrier after the cleaner removes the remaining toner.

3. The image forming apparatus of claim 2, wherein the specific position is located (i) in the vicinity of the cleaner, or (ii) in the vicinity of the cleaner and in the vicinity of the transfer position.

4. The image forming apparatus of claim 1, wherein the obtaining unit obtains the information in the vicinity of the transfer position, and the stop position is located in the vicinity of and further downstream than the transfer position in the rotational direction.

5. The image forming apparatus of claim 1, wherein the obtained information includes at least one of environmental information on the vicinity of the cleaner and environmental information on the vicinity of the transfer position, and the environmental information includes at least one of temperature and humidity.

6. The image forming apparatus of claim 5, wherein the environmental information on the vicinity of the cleaner includes environmental information on the outside of the image forming apparatus.

7. A method for stopping driving an image carrier performed by an image forming apparatus that transfers a toner image formed on the image carrier onto a transfer-receiving body at a transfer position, and removes toner remaining on the image carrier after transfer with use of a cleaner disposed at a cleaning position on a rotational path of the image carrier, the image carrier being driven to rotate by a driving unit, the method comprising:

an obtaining step of obtaining information indicating a likelihood of the remaining toner adhering to the image carrier;

a judging step of judging whether or not the likelihood indicated by the obtained information is equal to or lower than a predetermined value;

a setting step of, when the judging unit judges affirmatively, setting a position at which the likelihood is equal to or lower than the predetermined value as the stop position; and a controlling step of controlling, at an end of an image forming job, the driving unit:

(i) to stop driving the image carrier at the stop position before a rear end, with respect to a rotational direction of the image carrier, of an area of the image carrier on which the toner remains reaches the cleaning position and when the rear end reaches the stop position, when the judging step judges that the likelihood is equal to or lower than the predetermined value, and, (ii) to stop driving the image carrier after the cleaner removes the remaining toner, when the judging step judges that the likelihood is higher than the predetermined value.

8. The method for stopping driving the image carrier of claim 7, wherein the obtaining step estimates, based on the information obtained at a specific position on the rotational path, a variation of the likelihood in a region from the transfer position to the cleaning position on the rotational path in the rotational direction, the judging step further judges whether or not the region includes a position at which the likelihood is equal to or lower than the predetermined value, and when the judging step judges negatively, the controlling step controls the driving unit to stop driving the image carrier after the cleaner removes the remaining toner.

9. The method for stopping driving the image carrier of claim 8, wherein the specific position is located (i) in the vicinity of the cleaner, or (ii) in the vicinity of the cleaner and in the vicinity of the transfer position.

10. The method for stopping driving the image carrier of claim 7, wherein the obtaining step obtains the information in the vicinity of the transfer position, and the stop position is located in the vicinity of and further downstream than the transfer position in the rotational direction.

11. The method for stopping driving the image carrier of claim 7, wherein the obtained information includes at least one of environmental information on the vicinity of the cleaner and environmental information on the vicinity of the transfer position, and the environmental information includes at least one of temperature and humidity.

12. The method for stopping driving the image carrier of claim 11, wherein the environmental information on the vicinity of the cleaner includes environmental information on the outside of the image forming apparatus.

* * * * *